United States Patent [19]

Gary

[11] Patent Number: 4,999,754

[45] Date of Patent: Mar. 12, 1991

[54] DECORATIVE SCONCE ASSEMBLY

[75] Inventor: Lonnie F. Gary, Lubbock, Tex.

[73] Assignee: Gary Products Group, Inc., Lubbock, Tex.

[21] Appl. No.: 430,780

[22] Filed: Nov. 2, 1989

[51] Int. Cl.[5] ..... F21S 1/02

[52] U.S. Cl. ..... 362/237; 362/249; 362/806

[58] Field of Search ..... 362/145, 147, 237, 238, 362/239, 246, 248, 249, 250, 351, 353, 355, 359, 360, 361, 806

[56] References Cited

U.S. PATENT DOCUMENTS

| | | | |
|---|---|---|---|
| 2,714,652 | 8/1955 | Meyer | 362/249 |
| 3,253,137 | 5/1966 | Richter, III | 362/248 |
| 3,692,993 | 9/1972 | Robinson | 362/250 |
| 4,234,915 | 11/1980 | Malinowski et al. | 362/806 |
| 4,827,382 | 5/1989 | Feliks | 362/806 |
| 4,851,977 | 7/1989 | Gary | 362/249 |
| 4,884,178 | 11/1989 | Roberts | 362/249 |
| 4,888,671 | 12/1989 | Reimer | 362/250 |
| 4,901,212 | 2/1990 | Prickett | 362/145 |

FOREIGN PATENT DOCUMENTS

| | | | |
|---|---|---|---|
| 1093522 | 1/1981 | Canada | 362/248 |

*Primary Examiner*—Ira S. Lazarus
*Assistant Examiner*—Richard R. Cole
*Attorney, Agent, or Firm*—Ross, Howison, Clapp & Korn

[57] ABSTRACT

A decorative sconce assembly requiring no permanent wiring is adapted for use with decorative light strings having a plurality of bulb and socket assemblies connected to a common electrical conductor, said sconce assembly comprising a shade member, a socket support member adapted to slidably engage the shade member while maintaining a decorative bulb and socket assembly in fixed relation to the shade member, and members for attaching the decorative sconce assembly to the underlying support surface.

1 Claim, 2 Drawing Sheets

DECORATIVE SCONCE ASSEMBLY

BACKGROUND OF THE INVENTION

1. Field of the Invention

This invention relates to decorative lighting, and more particularly, to a sconce assembly useful for installing decorative lighting on walls, fences, or other substantially planar, usually vertical support surfaces. The sconce assembly disclosed herein is particularly useful with conventional, commercially available light strings comprising a plurality of decorative bulb and socket combinations linked in either series or parallel relationship by common conductors to an electrical outlet or other power supply.

2. Description of the Prior Art

The use of wall sconces in decorative lighting is well known. Such sconces, particularly those intended for permanent use, are typically self-contained assemblies having a base portion that is permanently mounted by screws or the like on a wall or other support surface. The base portion usually comprises a socket that is permanently wired into the electrical system of the building on which the sconce assembly is installed. The socket is adapted to receive a conventional threaded light bulb, and decorative glass or plastic shades are connected to the base assembly for appearance purposes and to diffuse or direct the light emanating from the bulb during use.

While sconce assemblies as disclosed above are satisfactory for permanent installation, they are too expensive and time-consuming for use in decorative applications where the lighting is to be installed, used and removed within the space of a few days, hours or weeks. A particular need exists for backyard or patio lighting that is attractive, economical, easy to remove and install, and which can be conveniently attached to yard fences, decks, railings, patio walls, and the like, without the need for permanent wiring.

SUMMARY OF THE INVENTION

According to the present invention, a decorative sconce assembly is provided that comprises two interlocking, injection moldable structural members adapted to support a decorative bulb and socket assembly on a substantially planar support surface.

According to a preferred embodiment of the invention, the subject sconce assembly comprises a decorative shade, a socket support member, means for providing interlocking engagement between the shade and socket support member, and means for attaching the shade to a substantially planar support surface.

According to another embodiment of the invention, a sconce assembly is provided that comprises a shade, a socket support member adapted to slidably engage the shade, and means for attaching the interlocked shade and socket support member to a substantially planar support surface.

According to another embodiment of the invention, a decorative sconce assembly is provided that comprises interlocking shade and socket support members, means for reversibly attaching the interlocked shade and socket support member to a support surface, and a decorative bulb and socket assembly.

BRIEF DESCRIPTION OF DRAWINGS

The decorative sconce assembly of the invention is further described and explained in relation to the following figures of the Drawings in which.

Like numbers are used to indicate like parts in all figures of the Drawings.

DESCRIPTION OF THE PREFERRED EMBODIMENT

Figure 1:
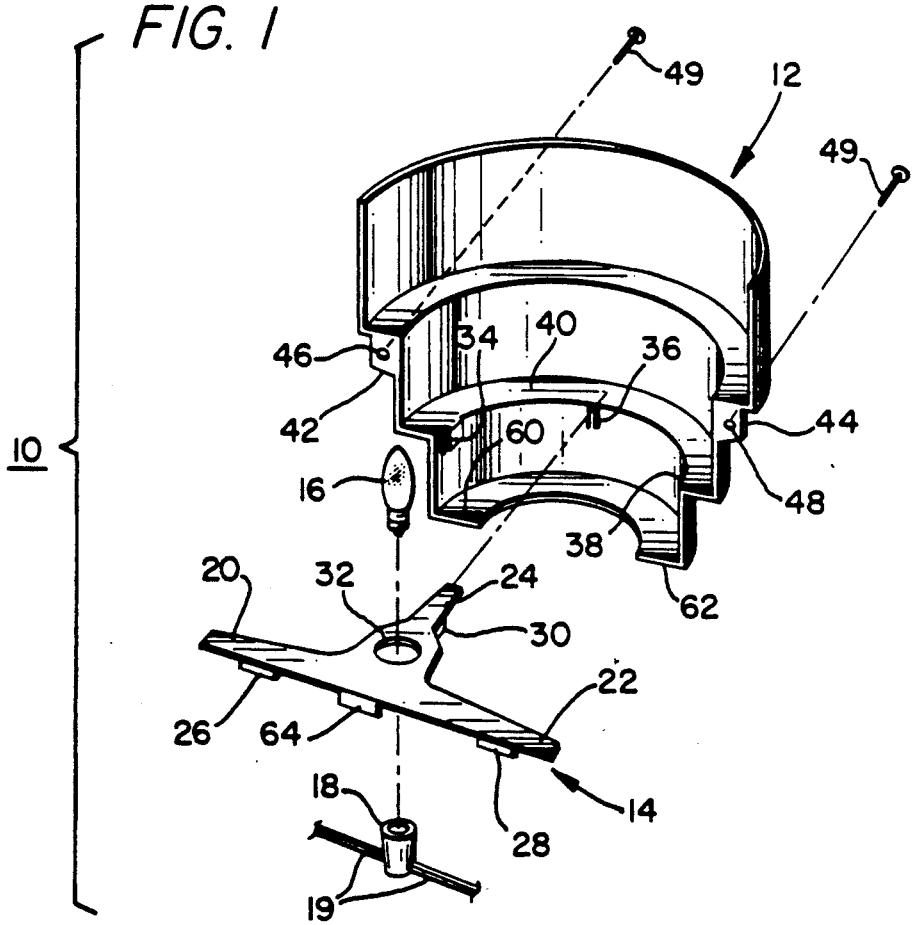
FIG. 1 is an exploded perspective view depicting a preferred embodiment of the decorative sconce assembly of the invention.

Referring to FIG. 1, decorative sconce assembly 10 preferably comprises shade 12 and socket support member 14, both of which are preferably adapted to be injection molded from a suitable, commercially available polymeric resin. Although the configuration of shade 12 and socket support member 14 are characterized by certain desirable structural elements as are described in more detail below, it is understood that the outward shape and appearance of shade 12 and structural support member 14 can vary greatly within the scope of the invention, so long as the desired functional objectives are achieved.

As shown in FIG. 1, shade 12 is desirably unitarily molded in an arcuate, stairstep configuration. According to a particularly preferred embodiment of the invention, shade 12 is molded from a translucent, polymeric resin which, if intended for outdoor use, will desirably comprise a minor portion of an ultraviolet light stabilizer as one of its constituents. Paired ridges, 34, 36, 38, are preferably molded onto the interiorly facing surface of shade 12 to define slots into which tabs on socket support member 14 can be slidably inserted. Ears 42, 44 are also desirably unitarily molded as a part of shade 12, and preferably comprise rearwardly facing mounting surfaces that are substantially co-planar to facilitate mounting decorative sconce assembly 10 on a planar surface. Holes 46, 48 are provided in ears 42, 44, respectively, to facilitate the insertion of fasteners such as screws 49 through ears 42, 44 to secure shade 12 to a support surface.

Figure 2:
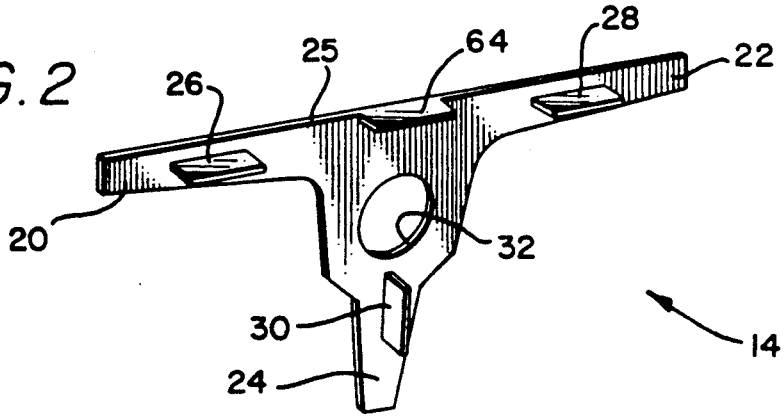
FIG. 2 is a perspective view of the socket support member of the decorative sconce assembly of the invention.

Socket support member 14 can be molded from the same or a different polymeric resin, and preferably has enough strength and rigidity to support decorative bulb and socket assembly 16, 18 within shade 12. Referring to FIGS. 1 and 2, socket support member 14 further comprises support arms 20, 22, 24, which are preferably co-planar so that they can rest flat against surface 40 of shade 12 whenever socket support member 14 is slidably engaged with shade 12. Aperture 32 in socket support member 14 should have a diameter larger than the base but smaller than the bulb portion of decorative bulb 16. During the assembly of decorative sconce assembly 10 of the invention, the threaded base portion of decorative bulb 16 is preferably inserted through aperture 32 of socket support member 14 and then threaded into engagement with socket 18 disposed thereunder. Socket 18 is further provided with electrical conductors 19 that are linked in series or parallel connection, as desired, with a plurality of other such bulb and socket assemblies. Once decorative bulb 16 and socket 18 are threaded together with socket support member 14 therebetween, socket support member 14 is desirably brought into sliding engagement with shade 12.

The sliding engagement between shade 12 and socket support member 14 is preferably accomplished by means of tabs 26, 28, 30 on socket support member 14, which are adapted to slide between paired slots 34, 36, 38 of shade 12. Tabs 26, 28, 30 are desirably spaced far enough back from the ends of arms 20, 22, 24, respectively, so they do not prevent arms 20, 22, 24 from resting flush against support surface 40 of shade 12.

Figure 3:
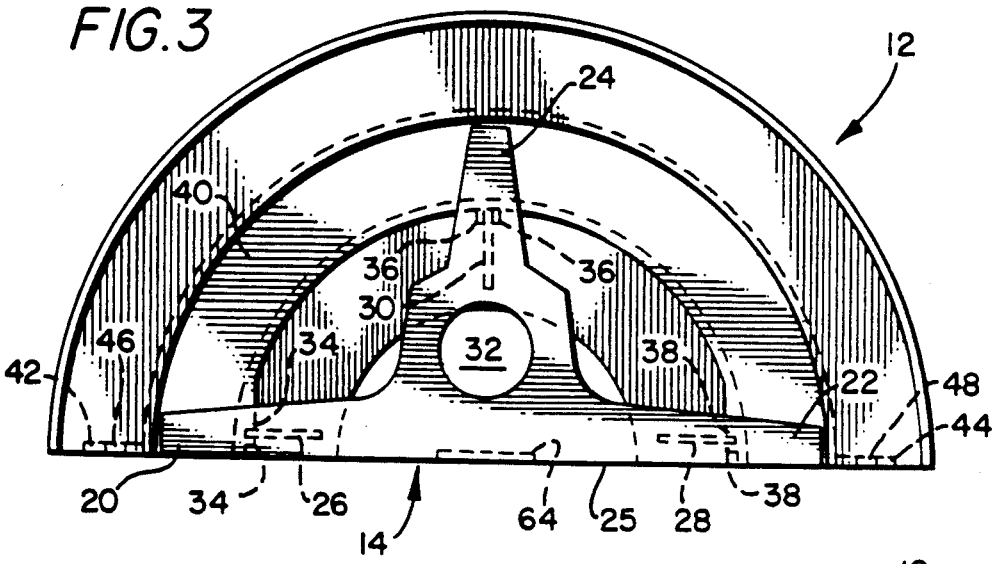
FIG. 3 is a plan view depicting the shade and socket support member of the invention when assembled in reversible, slidably interlocking engagement.
Figure 4:
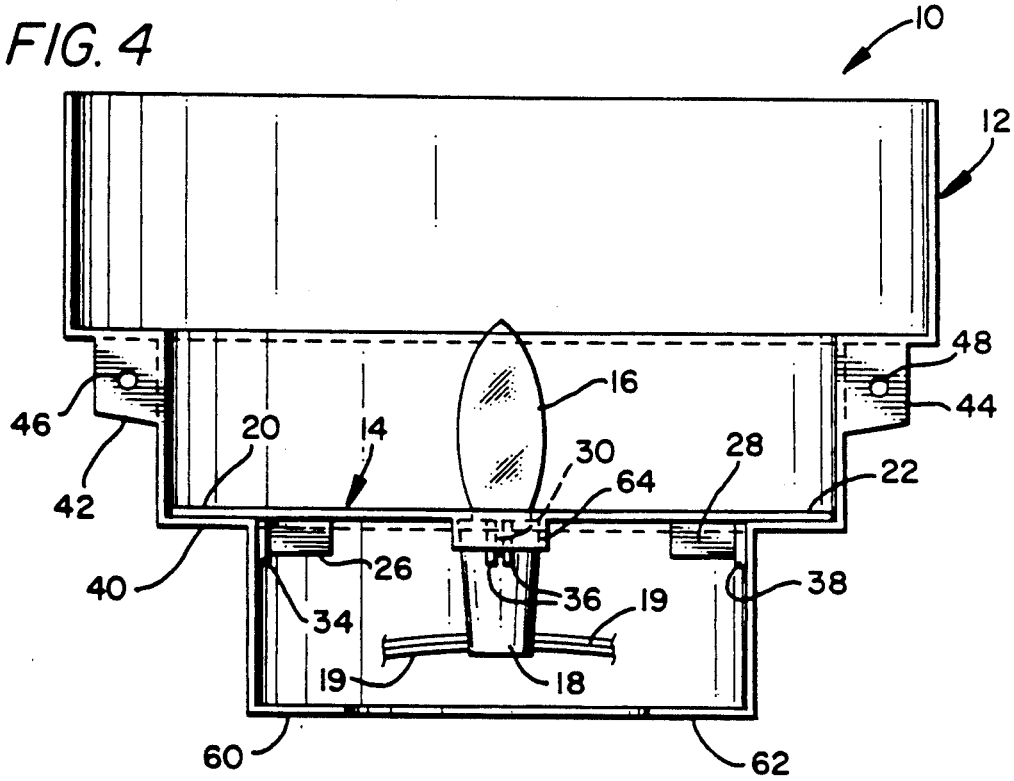
FIG. 4 is a rear elevation view depicting the shade, socket support member and a decorative bulb and socket assembly in fully assembled form.

The manner in which support arms 20, 22, 24, support surface 40, tabs 26, 28, 30 and paired ridges 34, 36, 38 cooperate to provide reversible sliding engagement between shade 12 and socket support member 14 is better understood with reference to FIGS. 3 and 4. Referring to FIG. 3, it is also seen that rear edge 25 of socket support member 14 does not extend beyond the plane of the rearwardly facing mounting surface of ears 42, 44, thereby avoiding any interference with mounting decorative sconce assembly 10 on a substantially planar support surface.

Referring to FIG. 4, it is seen how decorative bulb 16 and socket assembly 18 are supported within shade 12 by socket support member 14 in decorative sconce assembly 10 of the invention. Socket support member 14 and shade 12 cooperate when slidably engaged as described above, to maintain decorative bulb 16 in an alignment that enables bulb 16 to project light bisymetrically through and out the top of shade 12.

Figure 5:
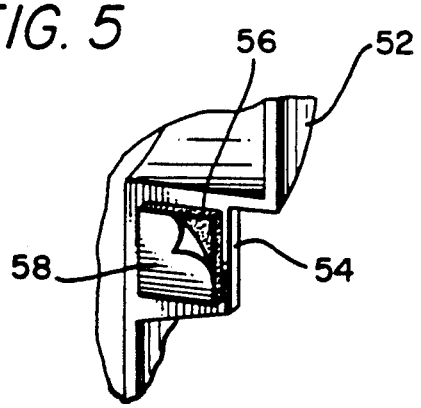
FIG. 5 is a detailed perspective view depicting an alternative means for attaching the shade of the subject decorative sconce assembly to a support surface.

According to a preferred embodiment of the invention, and referring to FIG. 1, edges 60, 62 of shade 12 are adapted to cooperate with ears 42, 44 in distributing the weight of decorative sconce assembly 10 against the support surface without placing excessive stress on fasteners 49 or other means used to secure decorative sconce assembly 10 to the support surface. One such alternative means for fastening the decorative sconce assembly of the invention to a support surface is depicted in FIG. 5, which is a detailed view of a shade 52 similar to that shown in FIGS. 1, 3 and 4, except that adhesive pad 56 is secured to ear 54 for use in attaching shade 52 to the support surface. Cover sheet 58 is desirably removed from adhesive pad 56 prior to attaching shade 52 to the support surface.

Referring to FIG. 2, rib 64 is desirably provided to increase the rigidity along back edge 25 of socket support member 14, although it is understood that the need for rib 64 or another similarly effective structure will depend upon the shade material and thickness of socket support member 14.

Other alterations and modifications of the subject invention will become obvious to those of ordinary skill in the art upon reading this disclosure, and it is intended that the present invention be limited only by the broadest interpretation of the appended claims to which the inventor may be legally entitled.

I claim:

1. A sconce assembly adapted for use with a string of decorative lights comprising a plurality of decorative bulb and socket assemblies linked to a power supply by an electrical conductor, said sconce assembly comprising moldable polymeric shade and socket support members;

said socket support member further comprising an aperture adapted to receive and support said decorative bulb and socket assembly;

said shade member comprising a plurality of spaced-apart, substantially co-planar surfaces adapted to contact a substantially planar support surface, and means for attaching said shade member to said planar support surface;

means for providing sliding engagement between said shade member and said socket support member; and means for restricting the sliding engagement between said shade member and said socket support member, so as to support and maintain said decorative bulb and socket assembly in substantially fixed relation to said shade member whenever said shade member is attached to said substantially planar support surface.

* * * * *